US005285610A

United States Patent [19]

Schaaf et al.

[11] Patent Number: 5,285,610

[45] Date of Patent: Feb. 15, 1994

[54] BUILDING BLOCKS AND THEIR USE

[76] Inventors: Cecil F. Schaaf, 3015 Palmer Rd., Standish, Mich. 48658; Craig R. Schaaf, 741 Crawford St., Flint, Mich. 48507

[21] Appl. No.: 848,418

[22] Filed: Mar. 6, 1992

[51] Int. Cl.[5] ..... E04B 5/04

[52] U.S. Cl. ..... 52/602; 52/223.7; 52/589; 52/608

[58] Field of Search ..... 52/589, 223.7, 602, 52/608

[56] References Cited

U.S. PATENT DOCUMENTS 1,234,990 7/1917 Wilson .
1,495,896 5/1924 Ferguson ..... 52/602
1,526,730 2/1925 Zottoli ..... 52/602
1,700,542 1/1929 O'Donnell .
2,185,497 1/1940 Cilento et al. .
3,618,279 11/1971 Sease ..... 52/223.7
4,335,549 6/1982 Dean, Jr. .

*Primary Examiner*—Carl D. Friedman
*Assistant Examiner*—Beth A. Aubrey
*Attorney, Agent, or Firm*—Robert L. McKellar

[57] ABSTRACT

This invention deals with certain specific building blocks that when used in combination, are essentially the only required building blocks to construct an entire building including foundations, if required, floors, bonding beams, supporting and non-supporting walls supporting and non-supporting partitions, and roofs.

2 Claims, 5 Drawing Sheets

BUILDING BLOCKS AND THEIR USE

This invention deals with novel building blocks and their use to build inexpensive buildings.

More specifically, this invention deals with certain specific building blocks that when used in combination, are essentially the only required building blocks to construct an entire building, including the floors and the roofs thereof.

FIELD OF THE INVENTION

There are many various building blocks in use today, manufactured primarily from cementitious materials. Many of these blocks have been developed with configurations to accomodate various building activities, for example, the interlocking cement block provided by the disclosure of A. J. Cilento et al, in U.S. Pat. No. 2,185,497, issued on Jan. 2, 1940 in which there is shown an interlocking brick building product.

There exists many catalogs from block, brick, and tile manufacturers which illustrate a wide variety of building materials.

However, these currently available building materials are designed to do certain kinds of construction and they thus become part of the construction of a building along with various other materials such as lumber, glass, plastics, shingles, mortar, nails, screws, and other fastening means, and the like.

None of the building blocks currently available can be used in combination to build a complete building without depending on the other typical building materials, especially when it comes to constructing the roofs of such buildings.

THE PRIOR ART

Aside from the prior art provided by the Cilento et. al. disclosure, the applicants herein are aware of several other currently available building blocks which are standard and comprise the prior art.

For example, in U.S. Pat. No. 1,234,990, issued Jul. 31, 1917 to W. E. Wilson, there is disclosed a wall construction using hollow building blocks having an interiorly webbed construction that will allow them to cooperate when in a wall or other structure to afford horizontal air passages, while the vertical webs or walls lend support to any wall constructed therefrom. These building blocks do not seem to be designed to be used to construct roofs.

A second disclosure can be found in U.S. Pat. No. 1,700,542, which issued Jan. 29, 1929 to J. A. O'Donnell in which there is shown a building tile having a fluted surface which allows for the inclusion of cement or mortar when the blocks are used for building a wall. This disclosure does not indicate that the blocks disclosed therein can be used for roof structures.

Finally, there is disclosed in U.S. Pat. No. 4,335,549, which issued on Jun. 22, 1982 to Robert W. Dean a composite module, which is a building block which can be severed after it is manufactured, to be used for constructing a decorative exterior finished wall structure. This building block does not seem to have the capacity for fulfilling the needs that the blocks of the instant invention have.

Thus, none of the art known to the inventors is believed to anticipate or make obvious the building blocks of the instant invention or their use to build a building by using just the combination of the two types of blocks claimed herein.

THE INVENTION

The instant invention deals with novel building blocks that are useful for constructing buildings by using a combination of the blocks to build essentially the entire building, including foundations if required, walls, both supporting and non-supporting partitions, both supporting and non-supporting, bonding beams, roofs and floors.

Specifically, the instant invention deals with a building block, said block comprising a roof block formed from building materials, said roof block having a long axis and a short axis and an upper surface, two essentially identical end surfaces, and a flat bottom surface.

Each said roof block end surface is essentially flat and the upper surface of the roof block comprises three rails the rails being in vertical alignment with regard to the flat bottom surface of the roof block and each rail has a length equal to the long axis of the roof block.

The rails are aligned parallel to each other and further aligned in a spaced apart relationship to each other. The rails comprise a high center rail and two low tapered side rails wherein each low tapered side rail has a flat upper surface.

The high center rail also has a flat upper surface and two flat end surfaces coincidental with and forming part of the end surfaces of the roof block, and a mid-section located essentially mid-way between the flat upper surface of the high center rail and the bottom surface of the roof block, wherein the flat upper surface has a channel therein of predetermined depth, the channel being essentially centered in the flat upper surface of the high center rail and aligned parallel to the long axis of the roof block.

The channel has a length equal to the length of the high center rail.

The high center rail of the roof block has located in each of its end surfaces, a notch of predetermined depth, the notch having a bottom surface and an upper surface, wherein the notch is essentially located in the mid-section of the end surface of the center rail and located parallel to the flat upper surface of the high center rail such that the bottom surface of the notch lies in the same plane as the upper surfaces of the low side rails.

There is further provided by this invention a second block which is a wall block formed from building materials, the wall block has a long axis and a short axis.

The wall block provides a front wall, a back wall, two essentially identical end surfaces and two essentially identical side walls, wherein the side wall exterior surfaces are essentially flat and parallel to each other and essentially form a rectangular surface having long outside edges and short outside edges.

The back wall has an exterior surface and an interior surface and each wall block end surface has two grooves of predetermined depth in its planar surface thereof, each said groove being aligned parallel with the short axis of the wall block and located near a short outside edge of a side wall exterior surface.

Each groove has a length equal to the short axis of the wall block and the front surface comprises two front segments and two lateral wall surfaces, wherein the lateral wall surfaces have a leading edge and a terminating edge. Further, each front segment has a second groove of predetermined depth therein and each second groove is aligned parallel to the long axis of the wall block and is essentially centered in each front segment.

The second grooves have a length equal to the long axis of the wall block and each lateral wall surface constitutes an interior wall surface of the wall block, wherein each lateral wall surface extends towards each respective interior surface of the back wall, the terminating edge of the lateral wall surface intersects with and joins with the interior wall of the back wall so as to form therefrom a recessed area in the front of the block.

The recessed area is narrower in width at the point of intersection with the interior surface of the back wall relative to a wider width at the point of the leading edges of the lateral wall surfaces. In addition, the back wall has at least one modifiable indention located in its interior surface thereof, the use therefor being explained infra.

This invention also deals with a building, wherein the building is constructed essentially of two types of building blocks, the blocks being a combination of the blocks as described herein.

Also included within the scope of this invention is a method of constructing a building essentially from blocks. The method comprises using blocks as set forth and disclosed herein to construct all structural components of the building except the roof, and using the roof blocks as set forth herein for any roof structures of said building.

DETAILED DESCRIPTION OF THE INVENTION

This invention deals with two novel building blocks that will allow the construction of a building, including the roofs and the floors, from essentially a combination of only these two block types.

The first block of the two types described herein is a roof block.

Figure 1:
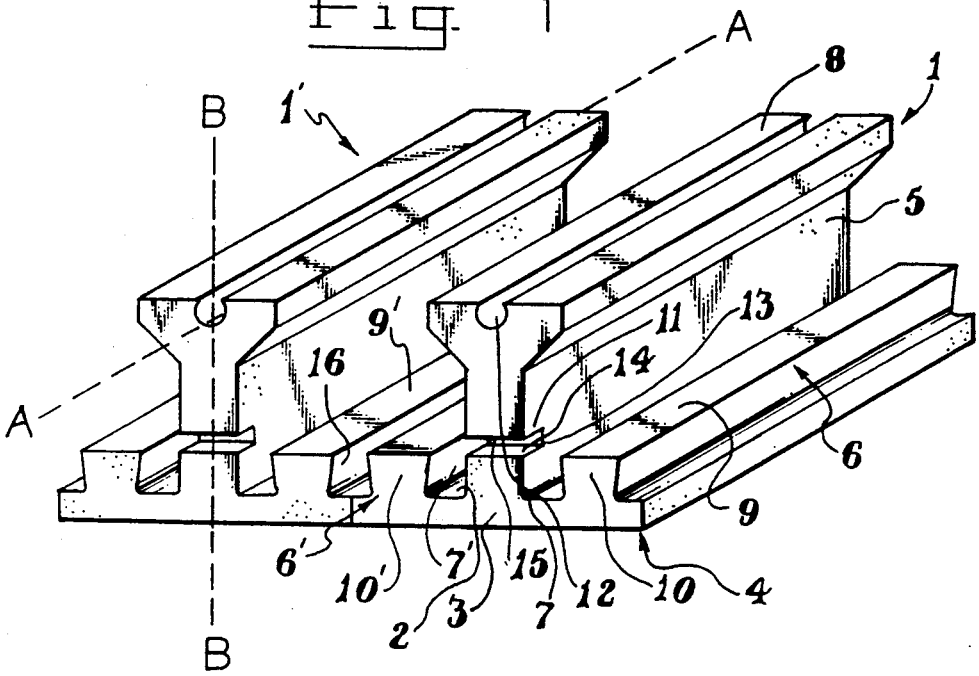
FIG. 1 is a view in perspective of a roof block of this invention joined with a like roof block of this invention to form part of a roof structure, the roof structure other than the blocks not being shown, as such structure and it s interrelated parts are shown in FIG. 11.

Two joined roof blocks of this invention are shown as an isometric view in FIG. 1 and are designated as 1 and 1'.

With reference to block 1, there is shown a building block which can be manufactured from any common building materials such as wood, concrete, plastic, foamed plastics, ceramics, tile, and the like, the most preferred for purposes of this invention being concrete, and foamed plastics, especially foamed insulating plastics.

As can be observed from FIG. 1', the block has a long axis as denoted by the broken line A—A, and a short axis denoted by the broken line B—B. For purposes of the description of the roof blocks herein, references will be made with regard to the long axis and the short axis, without there being any intent on the part of the inventors herein to require that the blocks have any particular orientation to be within the scope of the claims herein.

Figure 3:
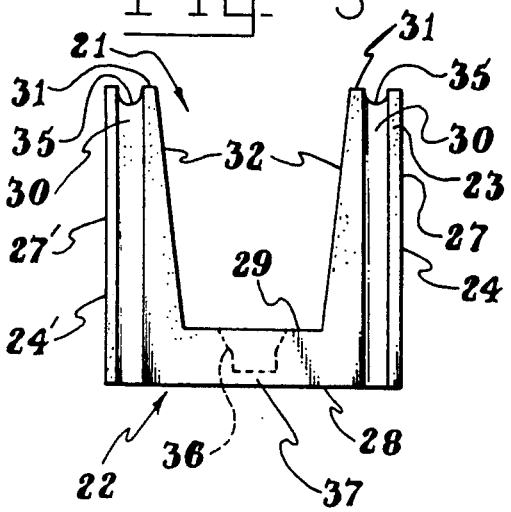
FIG. 3 is a top end view of a wall block of this invention.
Figure 4:
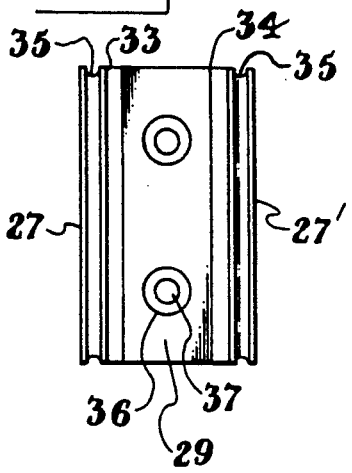
FIG. 4 is a front view of the wall block of this invention.

In it's broadest scope, and with reference to FIG. 1, there is shown an upper surface of the block 2, two essentially identical end surfaces 3 (one of which is not shown in the Figure, as they are essentially identical), and a flat bottom surface 4, the flat bottom surface being shown in FIG. 3. The end surfaces 3 are essentially flat in appearance and will be described in more detail infra.

The upper surface of the roof block 1 comprises three rails. The rails are a high center rail 5 and two low tapered side rails 6 and 6'. These rails are parallel to each other and as can be observed, they are spaced some distance from each other so as to allow open channels 7 and 7' to be formed between them. As can be noted from FIG. 10, the low tapered side rails 6 and 6' have a negative taper where the top of open channels 7 and 7' are narrower than the bottom of open channels 7 and 7'. This effect is required to enhance the strength of the construction. The strength is obtained by filling the open channels with grout or mortar after the reinforcing rod is in place and, with the negative taper, the grout or mortar cannot be moved from the open channels 7 and 7', thereby causing the reinforced steel rod to remain in place in the open channels 7 and 7'.

The rails 5, 6, and 6' are in vertical alignment with regard to the flat bottom surface 4 of the roof block 1, and each rail 5, 6, and 6' has a length which is equal to the length of the long axis A—A of the block.

Each of the rails 5, 6, and 6' have a flat surface shown as 8, 9, and 9', respectively. The combination of the high center rail 5 and two flat end surfaces of the rail, 10, and 10', combine and coincide with and form part of the end surfaces 3 of the roof block 1. The center rail 5 has a midsection 11 located essentially mid-way between the flat upper surface 8 of the high center rail 5, and the bottom surface 4 of the roof block 1. The flat upper surface 8 has a channel 12 therein, which channel 12 is of a predetermined depth placed there during the molding and manufacturing of the roof block 1. The channel 12 is centered in the middle of the flat upper surface 8 of the high center rail 5 and is aligned parallel to the long axis A—A of the roof block 1. The channel 12 has a length equal to the length of the high center rail 5. The channel 12 as shown in FIG. 1 is shown as a nearly round channel, with only a small opening at the top of the circle. This configuration allows the insertion of metal or plastic piping into the channels which can be used as an anchor points for panels that may be used to cover the roof blocks. Such anchoring can be for example, the use of wood screws, or other fasteners through the panels, and into the metal or plastic piping. Also contemplated within the scope of this invention is a keylock configuration similar to the keystone configuration in a stone archway. By using this configuration, the anchoring material will not come out of the channel.

The high center rail 5 has located in each of its end surfaces 3, a notch 13, it being understood by those skilled in the art that only one notch 13 in an end surface 3 per block is required in this invention, but that there can be notches 13 in both end surfaces 3 without detracting from the essence of this invention. The notch 13 has a predetermined depth, said notch 13 being formed into the end surface 3 during the molding and manufacturing of the roof block 1. The notch 13 has a bottom surface 14 and an upper surface 15 (not shown in FIG. 1). The notch 13 is essentially located in the mid-section 11 of the end surface 3 of the center rail 5 and is located parallel to the flat upper surface 8 of the high center rail 5 such that the bottom surface 14 of the notch 13 lies in the same plane as the upper surfaces 9 and 9' of the low tapered side rails.

The second block of this invention is the wall block it being understood by those skilled in the art that the designation "wall" as applied to this block is used so as to distinguish it from the roof block of this invention and that as such, the "wall" block has many uses besides constructing walls. For example, such blocks are used in the buildings of the instant invention for floor blocks and the like.

The wall block 20 of this invention can be formed from common building materials, similar to the materials used in the construction of the roof block 1.

Figure 2:
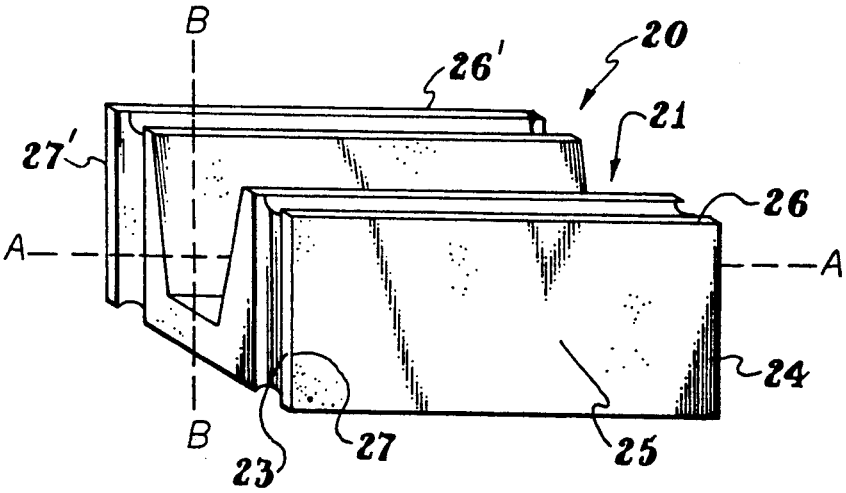
FIG. 2 is an isometric drawing of the wall block of this invention.

With reference to FIG. 2 there is shown therein a wall block 20 of this invention. Also shown therein are line A'—A'. which is the long axis of the wall block 20, and line B'—B', which is the short axis of the wall block 20. For purposes of the description of the wall blocks herein, references will be made with regard to the long axis and the short axis, without there being any intent on the part of the inventors herein to require that the blocks have any particular orientation to be within the scope of the claims herein.

In its broadest scope, the wall block 20 has a front wall 21, a back wall 22 and two essentially identical end surfaces 23 and 23', (23 not shown), it being understood that the end surfaces of the block are essentially identical. In addition, the wall block 20 has two essentially identical side walls 24 and 24' (shown in FIG. 3) wherein the side wall 24 and 24' exterior surfaces 25 and 25' (25 not shown in FIG. 2) are flat and parallel to each other and form rectangular surfaces having long outside edges 26 and 26', and short outside edges 27 and 27' (27' not shown in FIG. 2).

With regard to FIG. 3, the back wall 22 has an exterior surface 28 and an interior surface 29. Further with regard to FIG. 2, there is shown a top end view of the wall block 20. The end surface 23 has two grooves 30 of predetermined depth in its planar surface and each said groove 30 is aligned parallel with the short axis B'—B' of the wall block 20 and each of the grooves 30 are located near a short outside edge 27 and 27' of a side wall 24. Each of the grooves 30 have a length equal to the short axis B'—B' of the wall block 20.

The front surface 21 of the wall block 20 is comprised of two front segments 31 and two lateral wall surfaces 32, the lateral wall surfaces 32 having a leading edge 33 and a terminating edge 34, each said lateral wall surface 32 constituting an interior wall of the wall block 20 and each lateral wall surface 32 extends towards the interior surface 29 of the back wall 22 where the terminating edge 34 of the lateral wall surface 32 intersects with and joins with the interior wall of the back wall 22 so as to form a recessed area in the front of the wall block 20. The recessed area is narrower in width at the point of intersection with the interior surface 29 of the back wall 22 relative to a wider width at the point of the leading edges 33 of the lateral wall surfaces 32. The angle that this recessed area takes is not narrowly critical to the invention as long as the interior of the recessed area is narrower than the front of the recessed area.

Figure 12:
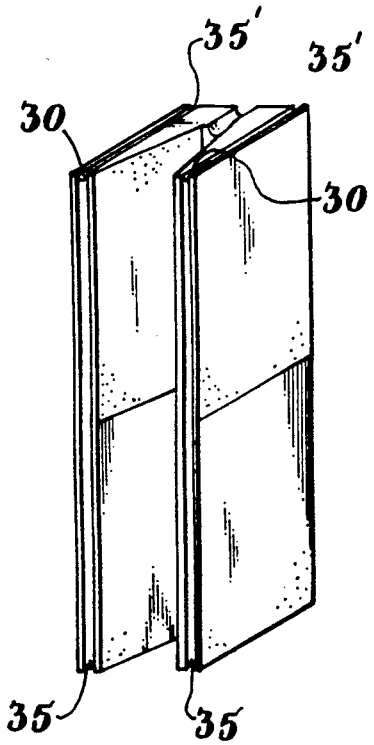
FIG. 12 is an isometric view of another embodiment of a wall block of this invention.
Figure 12A:
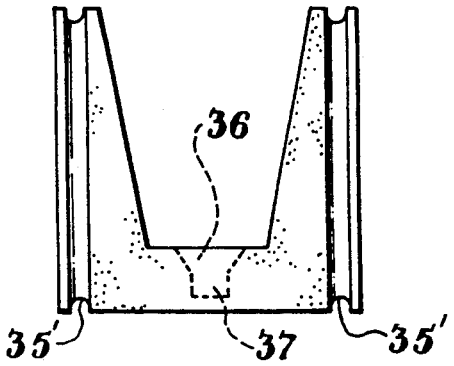
FIG. 12A is a top end view of another embodiment of a wall block of this invention.

Each of the front segments 31 has a groove 35 of predetermined depth in its surface, which has been designated herein as "second groove" in order to distinguish it from the other grooves of the block. Each of the grooves 35 are aligned parallel to the long axis A'—A' of the wall block 20 and are essentially centered in each front segment 31. Each of the grooves 35 have a length equal to the long axis A'—A' of the wall block 20. Also contemplated within the scope of this invention is the wall block illustrated in FIG. 12, wherein there is shown a wall block as described above and containing in addition thereto, a third set of grooves 35', said grooves being essentially identical to the grooves 35. The grooves 35' are located on the exterior surface 28 of the back wall 22, and are of essentially the same predetermined depth as the grooves 35. Further, the grooves 35' are in alignment with and a continuation of the grooves 30 and 35 such that each block so constructed has a continuous groove running around the outside edge, on both sides of the block.

The wall block 20 of this invention also has at least one modifiable indention 36 located in the interior surface of the back wall 22. It is preferable however to have at least two of these modifiable indentions 36. "Modifiable" as used in this invention means that the indention is placed in the back wall so that if required, the button part 37 of the modifiable indention 36 can be punched out to give an orifice or opening such that electrical wires and the like can be carried through the blocks. In this manner, the blocks can be prepunched as the wall blocks are laid to give essentially a continuous opening for the electrical wires, it being understood by those skilled in the art that where, a wall column has to be filled with mortar or cement to make a pillar or column, it is necessary that one use a plastic or metal tube as a tunnel through the cement from one block to another to allow the electrical cable and the like to have a continuous route without obstruction.

Figure 5:
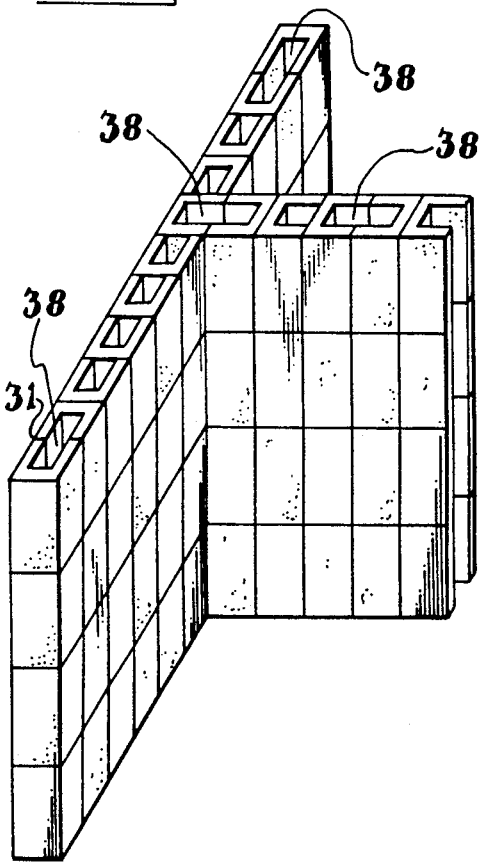
FIGS. 5, 6, and 7 show typical wall construction modes for the wall blocks of this invention.
Figure 6:
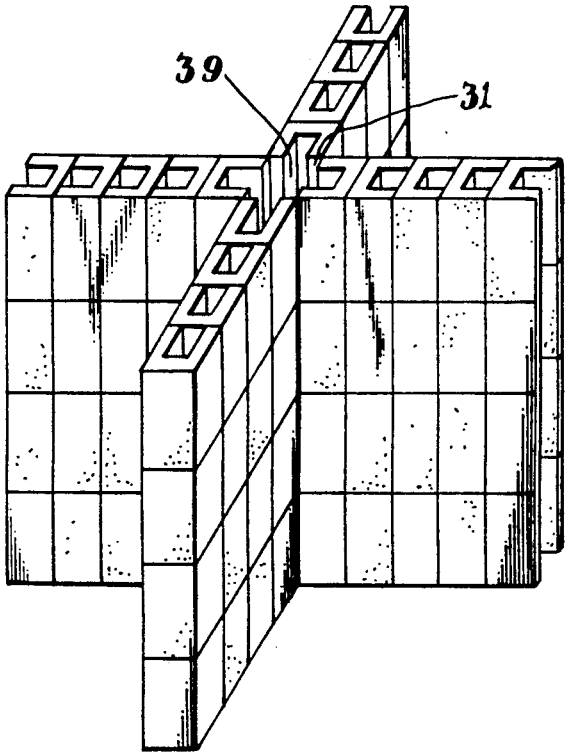
Figure 7:
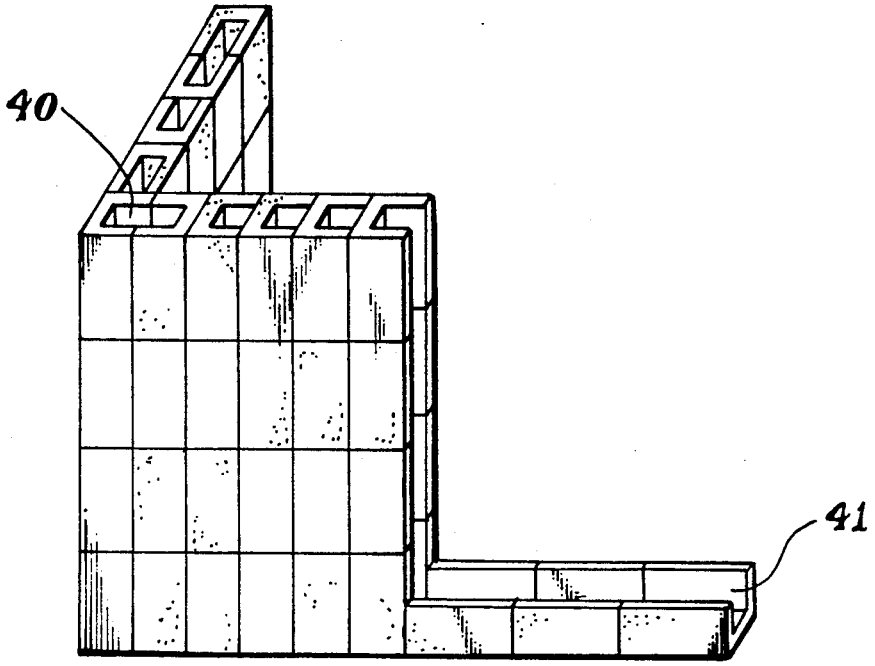

In constructing a building using these blocks, and with reference to FIGS. 5, 6, and 7, there is shown three common modes of wall structure that can be used to build the buildings of this invention. Specifically, with reference to FIG. 5, there is shown an isometric view of an intersecting wall, wherein there is shown a vertical stacking of the wall blocks of this invention and there is also shown the use of the wall blocks of this invention to form up a wall wherein at the points 38 the wall blocks are used such that their faces meet at the respective front segments 31 and are bonded together. The opening formed by such a configuration is then poured full of concrete or cement to essentially form a supporting pillar at each of the locations 38. It should be noted by those skilled in the art that these pillars can be placed at any point along the wall and that there does not seem to be a limit on the number of such pillars that can be used, except as limited from the length of the wall and the available blocks so configured in that wall.

With reference to FIG. 6 there is shown another wall configuration which is a full intersecting wall using vertical stacking of the wall blocks. Specifically, at point 39, there is shown a configuration which allows a full pillar to be utilized to support the intersecting walls.

With reference to FIG. 7 there is shown another wall configuration which is a full corner intersecting wall using vertical stacking of the wall blocks. Specifically, at point 40 there is shown a configuration from which a pillar can act as a corner post. Further, it should be noted from FIG. 7 that the wall blocks are being used in their horizontal stacking mode to give a trough 41, the use for which will become apparent by making reference to FIG. 9.

Figure 8A:
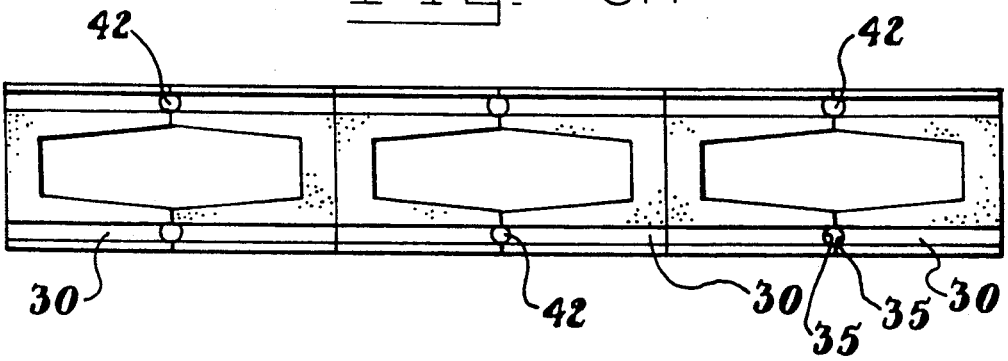
FIG. 8A is a top view of a wall constructed from the wall blocks of this invention having an alternate stacking pattern.

With reference to FIG. 8, there is shown top views of typical stacking patterns for the wall blocks of this invention wherein in FIG. 8A, there is shown an alternate stacking pattern and the grooves 35 and the grooves 30 are quite visible and show their relationship when the wall is assembled. Thus, the grooves 35 are shown at point 42 and as it can be observed, the grooves when mated together form a hole or opening for the insertion of vertical reinforcement rods while the grooves 30 show a linear alignment with grooves 30 from the other wall blocks, which provides a chase for the placement of further reinforcement rod. In addition to the wall columns that can be formed from certain of the vertically stacked walls, the construction can be reinforced even more by placing mortar, cement, adhesives, or the like in the rod holes around the reinforcing rods. Enough of this type of material needs to be used to force it down the holes and into the horizontal rod holes such that this material forms around all of the reinforcement rod, and extends into the horizontal rod holes to bind the entire construction together in a vertical and horizontal stability.

Figure 8B:
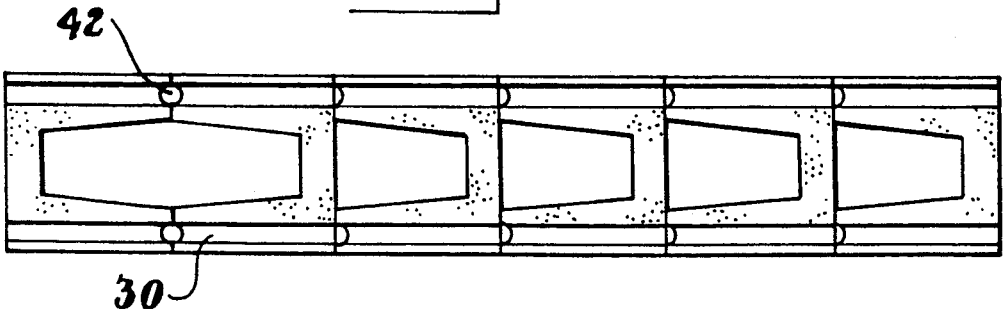
FIG. 8B is a top view of a wall constructed from the wall blocks of this invention having a lineal stacking pattern.

FIG. 8B shows a similar arrangement except the wall blocks are shown in a lineal stacking pattern. The difference in the alternate and the lineal stacking patterns, when a standard block size of 8"×8"×16" is used is that the configuration of FIG. 8A gives vertical reinforcement slots on 16 inch centers, while the arrangement in FIG. 8B gives vertical reinforcement slots on 8 inch centers, thus, illustrating the flexibility of the invention. With respect to the dimensions of the blocks disclosed herein, there is no critical limitation with regard to length, width, or heighth. Standard size block dimensions are usually preferred, as they tend to have the strength to weight ratio that is the most desirable. However, the roof blocks of this invention can be molded to be able to be used in long beam construction. For example, a normal 12 foot run of such a beam usually requires that the heighth of the roof block be about eight inches. However, if a longer beam is desired, for example a fourteen foot beam, then the heighth of the roof block should be about 10 inches in order to build enough strength into the block to have the supporting capability. Also, it is contemplated within the scope of this invention to use blocks larger or smaller than the standard dimensions of eight by eight by sixteen inches.

Figure 9:
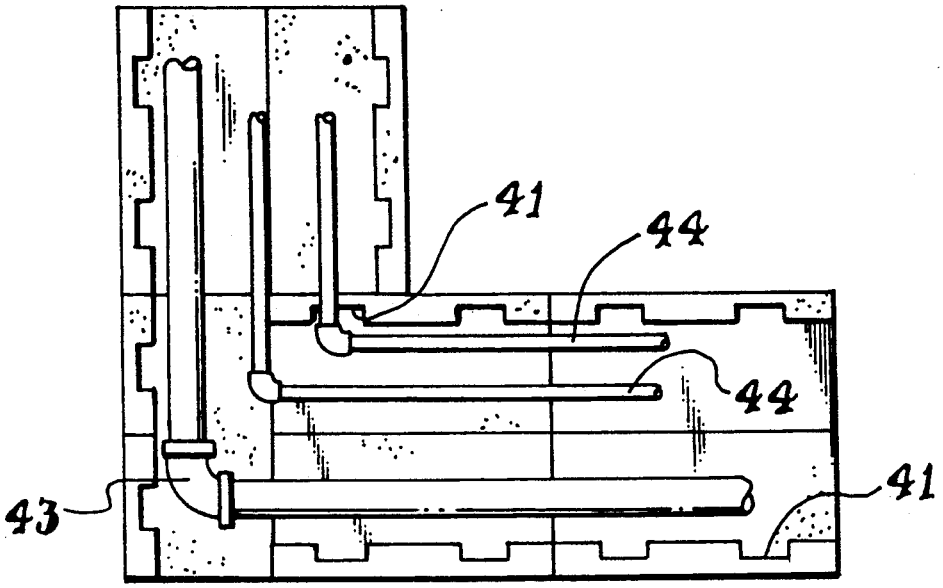
FIG. 9 is a schematic view of the interior of a wall constructed with the wall blocks of this invention, showing the possible location of the plumbing that would normally be used in the construction of the building of this invention.

FIG. 9 is a schematic view (not to scale) of the inside of a wall (not the interior surface of the wall) constructed with the wall blocks of this invention, showing the possible location of the plumbing that would normally be used in the construction of a building of this invention. Thus, for illustration purposes, 43 shows a drain run and 44 shows possible water runs, it being the intention of the applicants herein to also illustrate the trough 41 as shown in FIG. 7.

Figure 10:
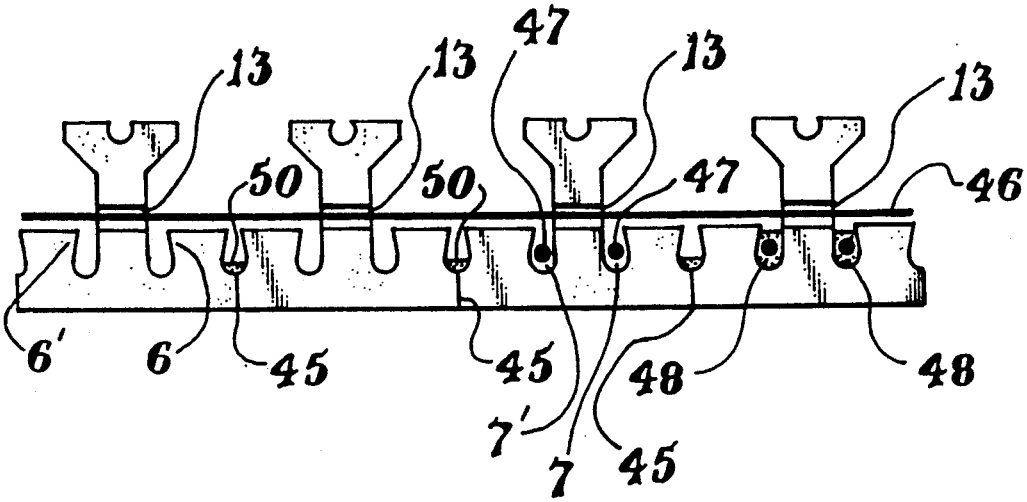
FIG. 10 is an end view of a roof that is constructed using the roof blocks of the invention.

FIG. 10 shows an end view of a portion of a roof that has been constructed using the roof blocks of this invention. There is shown four roof blocks abutted together at their side edges at points 45. There is further illustrated the notches 13 in horizontal alignment such that they form a chase for the insertion of a steel reinforcing rod 46. Further illustrated is the placement of the steel reinforcement rod 47 in the channels 7 and 7'. There is also illustrated at 48, the use of grout over and around the steel rod 47. Also shown at 50 is the use of small amounts of grout to seal the opening that is formed by the dry abutment of the roof blocks when in place in a roof structure as shown at points 45.

Figure 11:
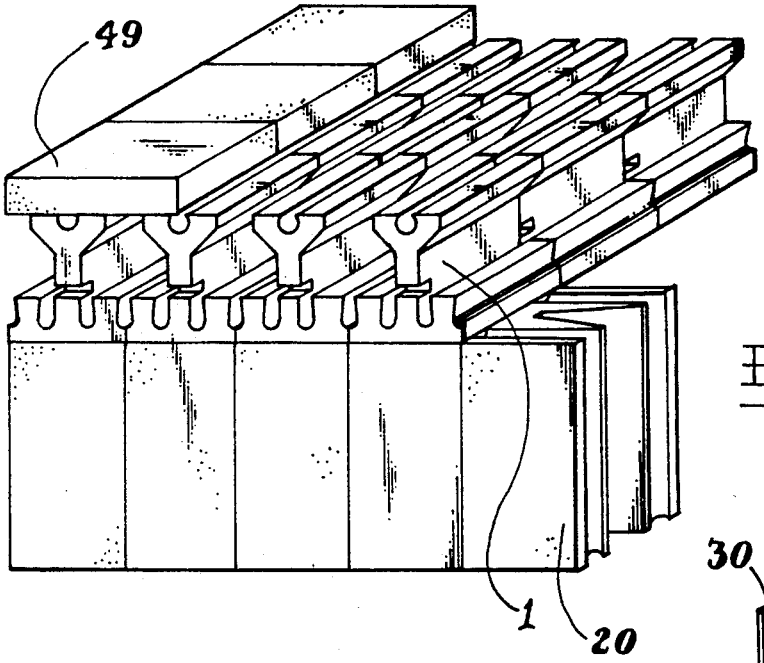
FIG. 11 is a construction using both the wall blocks and the roof blocks of this invention showing their relationship to each other in the construction of a building of this invention.

Finally, there is illustrated in FIG. 11, a portion of a building showing a wall using wall blocks 20 of this invention, a roof, comprised of the roof blocks 1 of this invention in combination with roof slabs or sheets 49 to form a roof structure supported by the wall structure. It should be noted by those skilled in the art, that contrary to the popular mode of construction wherein there are supporting roof members, the illustration does not show, nor does the construction of this invention require such supporting members, and thus the invention is unique in that regard.

In the construction of a building, the plans are drafted to give the construction worker the layout of the building, including the placement of the walls, both supporting and non-supporting, the location of the plumbing and electrical and other services, and the placement of the roof.

Foundations or footings for the building may or may not be used, depending on the soil on which the building is to be built and the general weather conditions of the territory in which the building is to be built. The wall blocks of this invention can, in fact, serve as a foundation when two courses of wall blocks are laid side by side, with the recessed area facing up, and then a single layer of the wall block in laid on the center of the two courses, wherein the second line of wall block is laid with its recessed area facing down, wherein the wall block facing down straddles the center of the wall blocks laying face up. The entire line is then filled with cement to stabilize the foundation and adhere the blocks together. A floor is either poured or built from Wall blocks on the foundation, and then the walls are constructed using the floor as the base. In order for one to construct the roof, the perimeter wall of the building must have a bonding beam constructed on top of it in order for the roof beams to be supported and in order for the eventual roof beams to have some place to rest and a place to be tied into the wall structures. The bonding beam is constructed using the wall blocks, wherein the wall blocks are laid horizontally on the top of the walls, recessed area face up to form a trough structure. The wall blocks of the trough are bonded end to end during this construction. The finishing step in the construction thus far, is to place the vertical reinforcing rod through the indentions in the back walls of the troughed wall blocks, and inserting the reinforcement rods therethrough and on into the wall structure itself. When these vertical rods are in place, the rod openings are poured full with concrete or mortar or adhesive, and enough material is used to cause the mortar to move down the rod hole and move horizontally through the horizontal rod holes which results in the vertical and horizontal bonds being formed inside the wall structure to stabilize the wall structure, while bonding the bonding beam to the wall itself.

The roof block beams are then fabricated. The roof is constructed by laying up temporary support members, laying the courses of roof blocks on the temporary support members and bonding the roof blocks end to end, but not edge to edge, and after the bonding material used for the construction has throughly dried, the temporary support members are removed. In an alternative mode of construction, the roof blocks can be laid out on a flat surface and the roof block beams can be constructed and the the beams can be placed in position on the bonding beam of the house.

The result is a building that is constructed essentially from the use of two type of blocks, the wall block and the roof block of this invention without resort to the more conventional building materials such as wood and the like. The buildings are structurally sound, are inexpensive to construct and highly economical such that they find extended use in economically depressed countries.

We claim:

1. A building block, said block comprising a roof block formed from building materials, said roof block having a long axis and a short axis:

said roof block providing an upper surface, two essentially identical end surfaces, and a flat bottom surface;

each said roof block end surface being essentially flat:

said upper surface of the roof block comprising three rails said rails being in vertical alignment with regard to the flat bottom surface of the roof block and each rail having a length equal to the long axis of the roof block, said rails being aligned parallel to each other and further aligned in a spaced apart relationship to each other, said rails comprising a high center rail and two low tapered side rails;

each said low tapered side rail having a flat upper surface;

said high center rail having a flat upper surface; and two flat end surfaces coincidental with and forming part of the end surfaces of the roof block, and a mid-section located essentially mid-way between said flat upper surface of the high center rail and the bottom surface of the roof block, said flat upper surface having a channel therein of predetermined depth, said channel being essentially centered in the flat upper surface of the high center rail and aligned parallel to the long axis of the roof block, said channel having a length equal to the length of the high center rail;

said high center rail of the roof block having located in each of its end surfaces, a notch of predetermined depth, said notch having a bottom surface and an upper surface, said notch being essentially located in the mid-section of the end surface of the center rail and located parallel to the flat upper surface of the high center rail such that the bottom surface of the notch lies in the same plane as the upper surfaces of the low tapered side rails.

2. A building block as claimed in claim 1 wherein it is constructed of cement.

* * * * *